US005586706A

United States Patent [19]

Ritzenhein

[11] Patent Number: 5,586,706

[45] Date of Patent: Dec. 24, 1996

[54] WAIST BAG

[76] Inventor: Mary E. Ritzenhein, 354 Western Ave., Fond du Lac, Wis. 54935

[21] Appl. No.: 375,797

[22] Filed: Jan. 20, 1995

[51] Int. Cl.[6] ..... A45C 13/18

[52] U.S. Cl. ..... 224/671; 224/251; 224/194; 224/587

[58] Field of Search ..... 224/151, 194, 224/240, 250–3, 269, 270, 228, 224, 226, 575, 587, 663, 671, 672

[56] References Cited

U.S. PATENT DOCUMENTS

| | | | |
|---|---|---|---|
| 1,961,181 | 6/1934 | Von Der Heydt | 224/253 X |
| 2,983,412 | 5/1961 | Ferguson | 224/253 X |
| 3,001,678 | 9/1961 | Maxwell | 224/194 X |
| 3,891,174 | 6/1975 | Harvey | 224/250 X |
| 4,029,243 | 6/1977 | Zerobnick et al. | 224/224 |
| 4,515,300 | 5/1985 | Cohen | 224/151 |
| 4,556,159 | 12/1985 | Swain | 224/269 X |
| 5,170,919 | 12/1992 | DeSantis et al. | 224/228 X |
| 5,294,028 | 3/1994 | Bankroff | 224/226 X |

*Primary Examiner*—Renee S. Luebke
*Attorney, Agent, or Firm*—Donald Cayen

[57] ABSTRACT

A waist bag has a pouch for carrying small personal items. Large loops are fastened to the pouch. The large loops enable a belt and its buckles to slide through the loops without resistance. When worn around a person's waist, the waist bag provides security for the pouch, because cutting the belt and pulling it from the person does not also pull the pouch. A hidden pocket in the pouch enhances security.

3 Claims, 3 Drawing Sheets

WAIST BAG

BACKGROUND OF THE INVENTION

1. Field of the Invention

This invention pertains to portable receptacles, and more particularly to small pouches for carrying personal items.

2. Description of the Prior Art

It has long been known for persons to use purses, back packs, and similar receptacles to carry small personal items. Numerous types of such prior receptacles have been developed to suit particular needs and fashions.

Recently, a personal carrying receptacle that is worn around the waist has become increasingly popular. The so-called fanny pack has a pouch, usually with a zippered cover, and a strap sewn to the pouch. A person places the pouch at a convenient location on her waist and ties the strap to hold the pouch in place. Cigarettes, billfolds, keys, and similar items can then be stored and carried in the pouch.

The fanny pack has several advantages over traditional purses and the like. A major advantage, of course, is that the fanny pack frees both hands for tasks other than carrying a purse. Another important benefit is that the danger of forgetting the purse some place is practically eliminated.

On the other hand, the prior fanny packs retain a major drawback of purses and the like. That drawback is their susceptibility to theft while being worn. Since the prior fanny pack pouch is sewn to the strap, cutting the strap and pulling it from the wearer also obtains the pouch and its contents.

Thus, a need exists for improvements in personal carrying receptacles.

SUMMARY OF THE INVENTION

In accordance with the present invention, a waist bag is provided that is considerably more resistant to theft than prior personal carrying receptacles. This is accomplished by apparatus that includes a pouch having large loops and a belt that freely passes through the loops.

The pouch preferably has five well defined sides and a closeable top. The loops are sewn or otherwise fastened to a back side of the pouch. The belt has buckles that enable a person to secure the pouch around her waist. The loops are sized to enable the belt and buckles to slide through them without resistance. A pair of bands on the top are designed to hold a small flashlight or can of personal anti-attack spray.

Further in accordance with the present invention, a pair of large clips are provided on the back side of the pouch. The hooks are held on respective short straps that are joined to the pouch near the loops. The clips are designed to attach to the waistband of a person's slacks, thereby enabling her to wear the waist bag without the belt. The clips snap securely to the waistband and thus provide ample protection against unintentional removal.

It is a feature of the present invention that it is fabricated with a hidden pocket in the back side of the pouch. The pocket has a zippered opening that preferably extends between the two loops. A strip of decorative material normally covers the zipper. The strip is designed to allow access to the zipper and pocket when desired.

The method and apparatus of the invention, using a belt and large loops, thus provide a waist bag that is less prone to theft than prior personal carrying receptacles. Clothing-engaging clips and a hidden pocket further enhance the security of the waist bag.

Other advantages, benefits, and features of the present invention will become apparent to those skilled in the art upon reading the detailed description of the invention.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
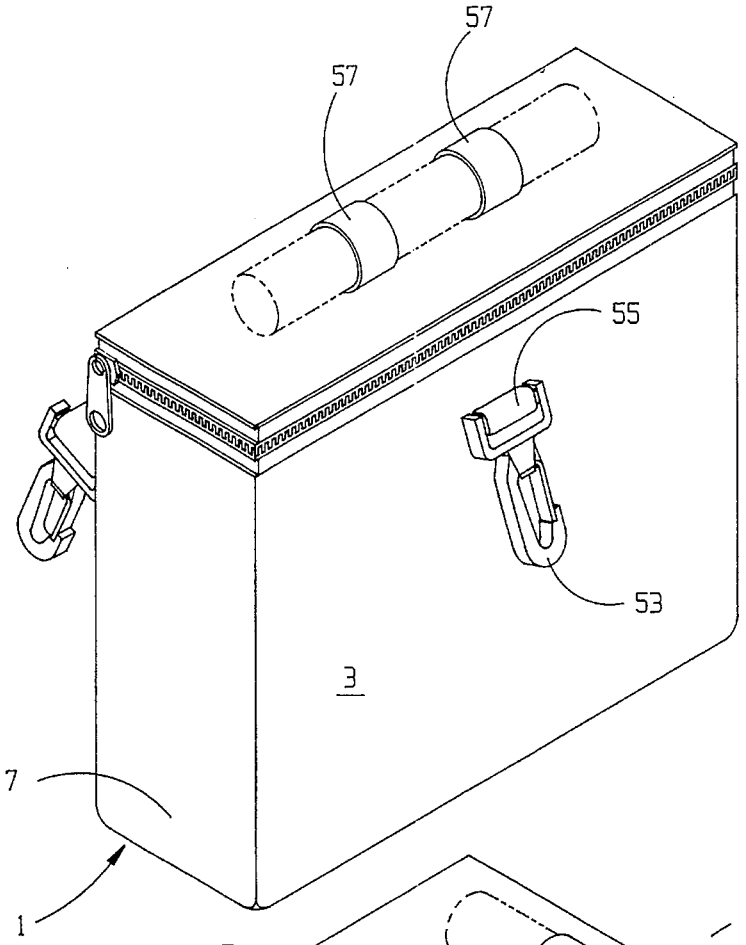
FIG. 1 is a perspective front view of the waist bag of the present invention.
Figure 2:
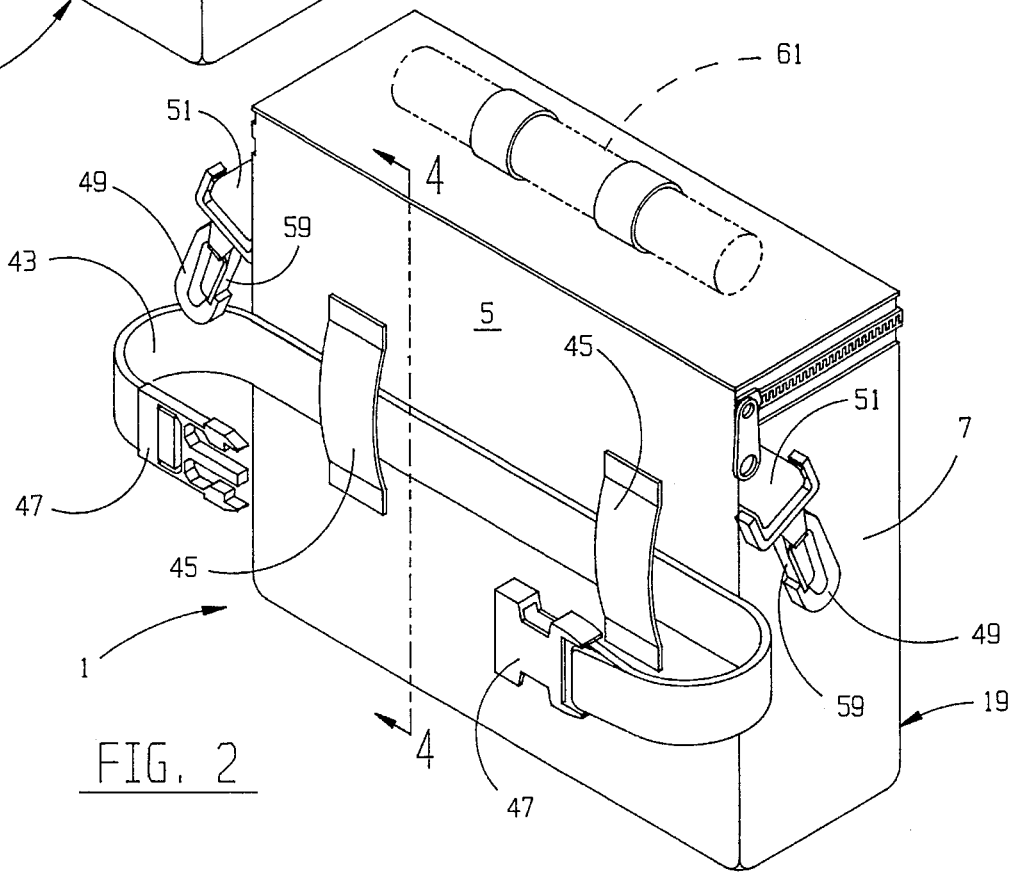
FIG. 2 is a perspective back view of the waist bag of the present invention.
Figure 5:
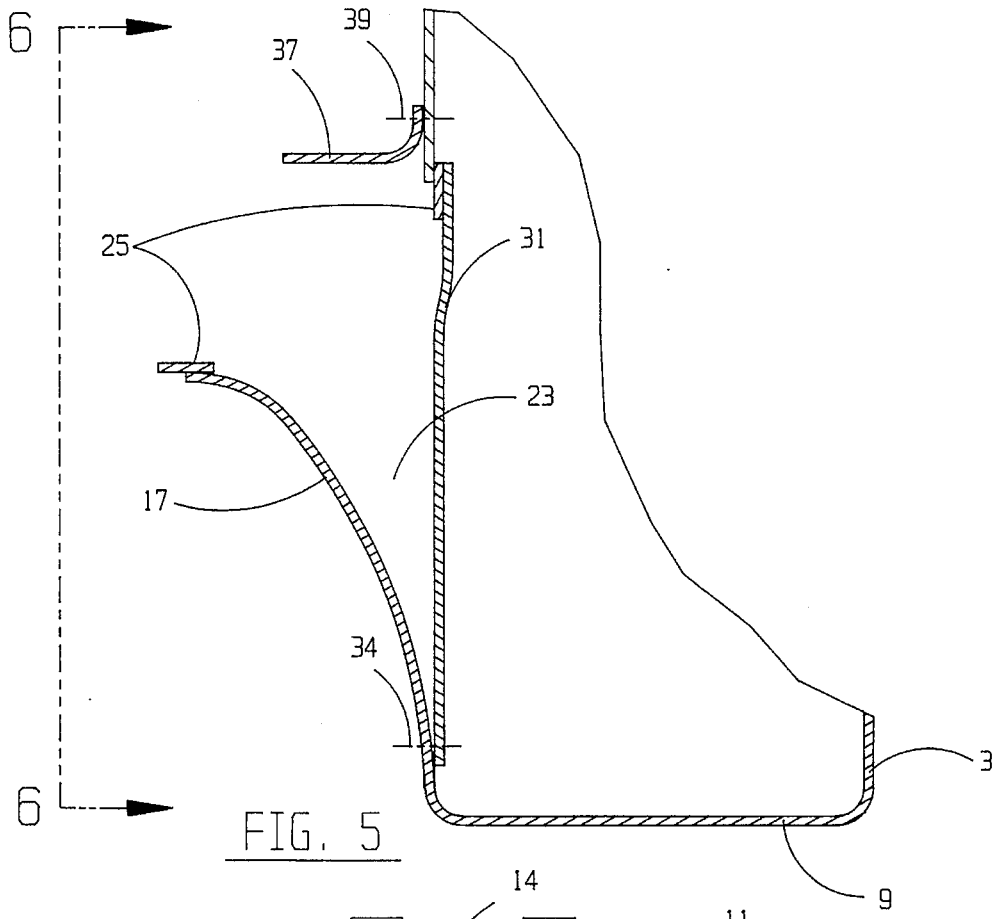
FIG. 5 is a partial view generally similar to FIG. 4, but showing the hidden pocket in an open condition and with the belt removed.
Figure 3:
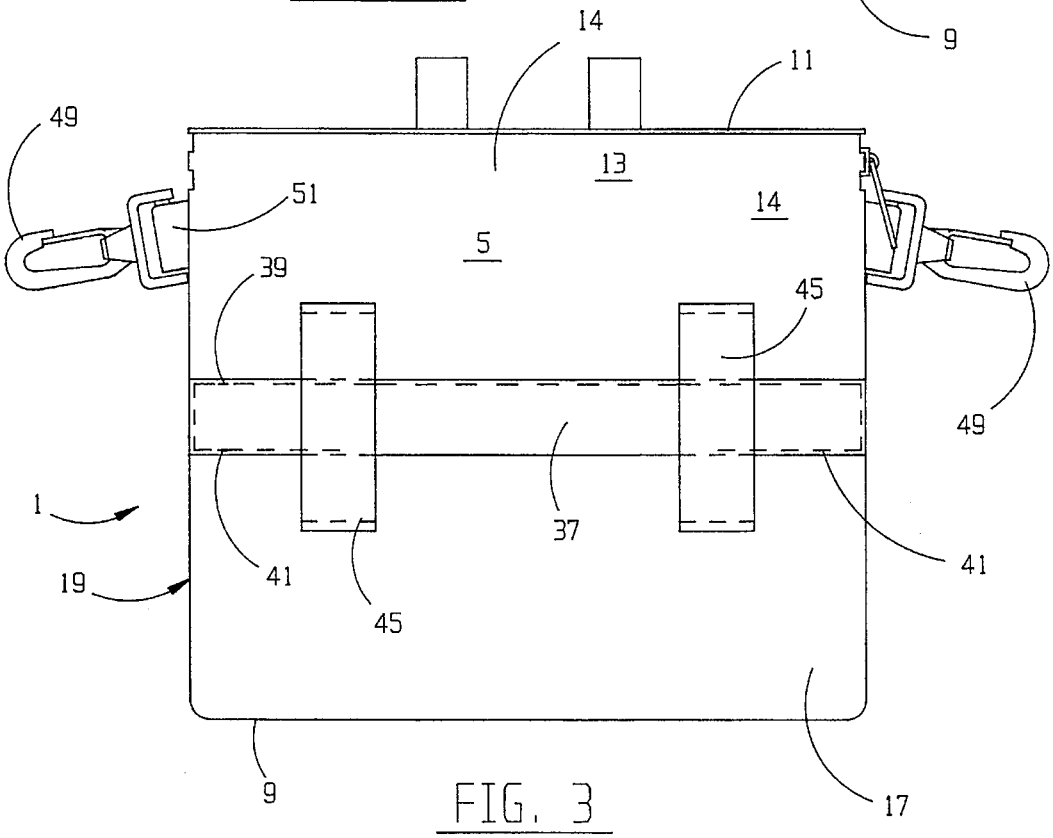
FIG. 3 is a back view of the waist bag with the belt removed.
Figure 4:
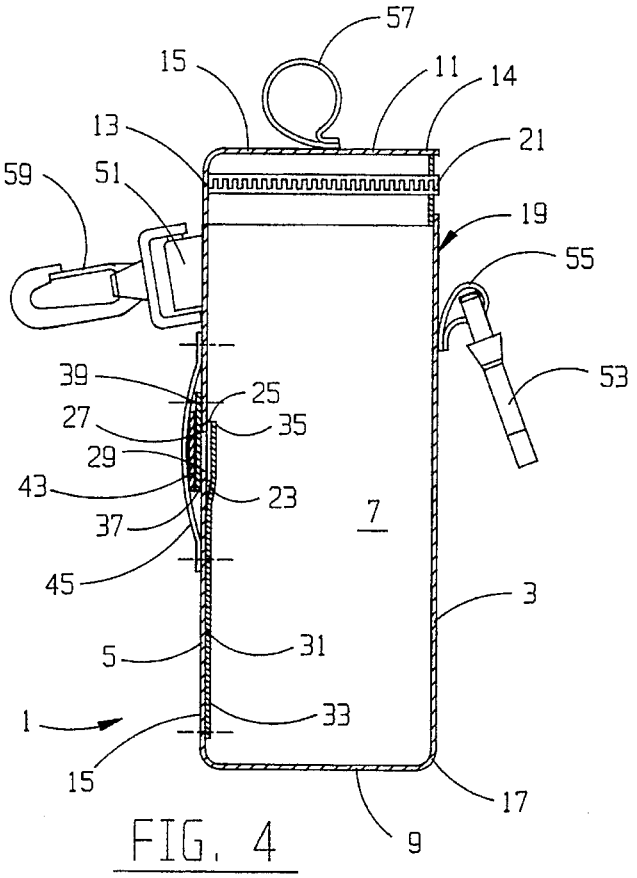
FIG. 4 is a cross sectional view taken along line 4—4 of FIG. 2 showing the hidden pocket in a closed condition.
Figure 6:
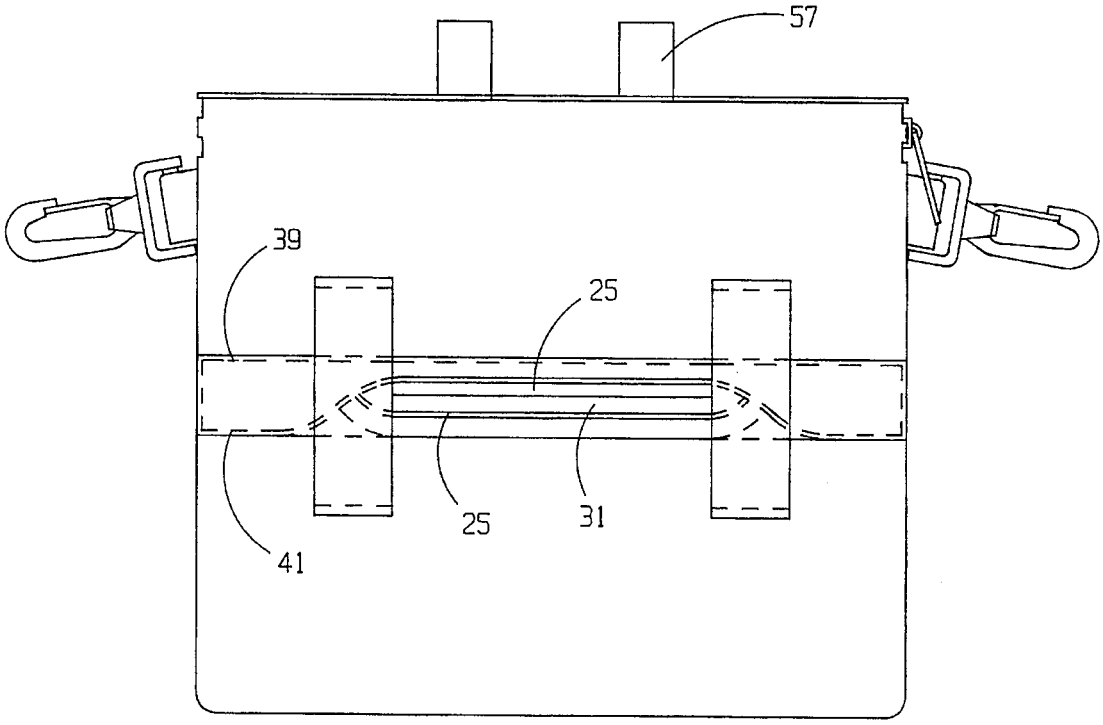
FIG. 6 is a view taken along line 6—6 of FIG. 5.

Referring to FIGS. 1–6, a waist bag 1 is illustrated that includes the present invention. The waist bag 1 is particularly useful for carrying small personal items around a person's waist. However, it will be understood that the invention is not limited to applications in which it is worn by a person.

The waist bag 1 has a front side 3, a back side 5, two ends 7, a bottom 9, and a top 11. The top 11 and the upper portion 13 of the back side 5 are made from a first piece 14 of flexible fabric. The front side 3, bottom 9, and lower portion 15 of the back side are made from a second piece 17 of fabric. The two ends 7 are made from respective pieces of fabric and are sewn to the first and second pieces 14 and 17, respectively, to form a generally rectangular shaped pouch 19. A zipper 21 having its two halves sewn to the top 11 and upper edges of the front side 3 and ends 7 enables a person to selectively open and close the pouch 19.

In accordance with the present invention, the pieces of fabric 14 and 17 are joined on the back side 5 of the pouch 19 so as to form a hidden pocket 23. For that purpose, the free edge 27 of the fabric piece 14 and the free edge 29 of the fabric piece 17 are connected by a zipper 25. A pocket piece 31 has a lower end 33 sewn along stitch line 34 to the inside of the back side 5 of the piece 17 near the pouch bottom 9. A top end 35 of the pocket piece 31 is sewn to the inside of the free edge 27 of the piece 14, preferably through the zipper 25.

To hide the zipper 25 from view, it is covered by a decorative strip 37. If desired, the strip 37 may be made from a strap material. The strip is sewn completely across the back side 5 of the fabric piece 14 along a stitch line 39. The strip is also sewn to the back side of the fabric piece 17 for short distances from the two ends 7 along two stitch lines 41.

To enable the pouch 19 to be worn with security around a person's waist, the waist bag 1 further includes a belt 43. The belt 43 fits through a pair of loops 45 sewn or otherwise fastened to the pouch back side 5. The belt has end buckles 47. The loops 45 are designed to be large enough to enable the belt and its buckles 47 to pass very easily through them. Preferably, the loops straddle the zipper 25 and the decorative strip 37.

A pair of clips 49 are attached to respective short straps 51. In turn, the straps 51 are joined to the pouch back side 5, preferably close to the ends 7. A similar clip 53 is attached to a short strap 55 that is joined to the pouch front side 3. A pair of elastic pieces are sewn to the top 11 so as to form respective coaxial bands 57.

In use, the belt 43 is threaded through the loops 45 of the pouch 19 and wrapped around a person's waist. The belt buckles 47 are connected, thereby enabling the person to carry items with her while leaving both hands completely free. The belt and loops cooperate to provide enhanced security to the waist bag 1 compared with prior personal carrying receptacles. Should a potential thief attempt to steal the waist bag by cutting the belt and pulling it, the belt and buckles merely slide without resistance through the loops. The thief is left with only the belt as he runs away, while the pouch and its contents remain behind with the wearer, who, although startled, would react quickly enough to grab the pouch upon sensing the thief's presence.

If desired, the person can wear the waist bag 1 by means of the clips 49 instead of the belt 43. The clips attach easily to the waistband of a person's slacks or skirt. However, the clips are difficult to remove unless their spring fingers 59 are intentionally released from the person's clothing. Consequently, the waist bag provides protection against theft or loss when worn by the clips 49 as well as when worn by the belt. The front clip 53 may be used to hold and provide ready access to a ring of keys or the like, not shown.

The elastic bands 57 are designed to hold a small flashlight or a spray can of personal anti-attack material such as pepper spray, designated by reference numeral 61. The spray can 61 is always at waist height, where it is in easy reach of a person's hands even if her upper arms are held by an attacker from the rear.

An example of a waist bag 1 that works very well is as follows. The pouch 19 is approximately 650 inches high, 8.50 inches wide, and three inches deep. Each loop 45 has an opening of three inches. The belt is one inch wide. The buckles are 1.25 inches wide and 0.31 inches thick. The elastic bands 57 are sized to accept a flashlight or anti-attack spray can having a diameter of 0.88 inches.

In summary, the results and advantages of personal carrying receptacles can now be more fully realized. The waist bag 1 of the invention provides both convenience for carrying small personal items and enhanced security against loss. This desirable result comes from using the coaction of the large loops 45 with the belt 43. The belt and loops cooperate to foil a potential thief who cuts the belt and runs with it, but without the pouch 19. The hidden pocket 23 and the clips 49 further contribute to the security of the waist bag.

It will also be recognized that in addition to the superior performance of the waist bag 1, its construction is such as to cost but little more than traditional personal carrying receptacles. The increased security provided by the invention amply justifies its moderate cost.

Thus, it is apparent that there has been provided, in accordance with the invention, a waist bag that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A waist bag comprising:

a. a belt having opposed ends with buckles thereon of predetermined size;

b. a pouch having front, back, top, and bottom sides and opposed ends, wherein:

i. the pouch back side has a lower portion fabricated from a first piece of flexible material and having an upper edge;

ii. the pouch back side has an upper portion fabricated from a second piece of flexible material and having a lower edge;

iii. a zipper connects the lower edge of the second piece of material to the upper edge of the first piece of material;

iv. a third piece of material is located inside the pouch and has an upper end sewn to the lower edge of the second piece of material adjacent the zipper and a lower end sewn to the first piece of material proximate the pouch bottom side; and v. a flexible decorative strip extends outside of the pouch back side between the two ends thereof and is sewn to the second piece of material proximate the zipper and sewn to the first piece of material for short distances from each of the two pouch ends, the decorative strip overlying the zipper; and c. a pair of loops fastened to the pouch back side and having a size sufficient to enable the belt and buckles to slide without resistance therethrough, so that a person can wear the waist bag around the person's waist and cutting and pulling the belt from the person does not pull the pouch from the person, and so that the upper edge of the first piece of material, the lower edge of the second piece of material, the zipper, and the third piece of material cooperate to form a hidden pocket in the back side of the pouch and the decorative strip selectively conceals the zipper.

2. A portable receptacle for carrying personal items around a person's waist comprising:

a. a pouch having front, back, top, and bottom sides and opposed ends, wherein:

i. the pouch back side is formed from top and bottom pieces of flexible material having lower and upper edges, respectively;

ii. a zipper is sewn between the lower and upper edges of the top and bottom pieces of material, respectively;

iii. a pocket piece of flexible material is sewn at a lower end thereof to the inside of the pouch back side adjacent the bottom side and at an upper end thereof to the lower edge of the top piece of material, the pocket piece cooperating with the zipper and the pouch top and bottom pieces of material to form a hidden pocket; and iv. a flexible strip is sewn to the lower edge of the top piece of material and covers the zipper;

b. at least two loops fastened to the pouch back side and having an opening therethrough of a predetermined size; and c. a belt passing through the loops and worn around the person's waist, the belt having end buckles sized to slide without resistance through the loop to thereby enable the belt and buckles to be pulled from the pouch without also pulling the pouch from the person.

3. The portable receptacle of claim 2 wherein:

a. the strip is sewn to the lower edge of the top piece of material for substantially the full distance between the pouch ends; and b. the strip is further sewn to the upper edge of the bottom piece of material for short distances extending inwardly from the pouch ends, so that the strip selectively conceals the zipper and can be folded to expose the zipper.

* * * * *